US011589656B2

(12) United States Patent
Roup et al.

(10) Patent No.: US 11,589,656 B2
(45) Date of Patent: Feb. 28, 2023

(54) METHODS OF MAKING WATERPROOF CURVED ZIPPERS

(71) Applicant: Talon Technologies, Inc., Woodland Hills, CA (US)

(72) Inventors: Herman Sydney Roup, Santa Barbara, CA (US); Steven Smith, Peterlee (GB)

(73) Assignee: Talon Technologies, Inc., Woodland Hills, CA (US)

( * ) Notice: Subject to any disclaimer, the term of this patent is extended or adjusted under 35 U.S.C. 154(b) by 0 days.

(21) Appl. No.: 17/828,628

(22) Filed: May 31, 2022

(65) Prior Publication Data

US 2022/0361633 A1 Nov. 17, 2022

Related U.S. Application Data

(60) Division of application No. 17/539,570, filed on Dec. 1, 2021, now Pat. No. 11,363,860, which is a continuation-in-part of application No. PCT/IB2020/061005, filed on Nov. 23, 2020.

(60) Provisional application No. 63/246,641, filed on Sep. 21, 2021, provisional application No. 62/939,590, filed on Nov. 23, 2019.

(51) Int. Cl.
*A44B 19/32* (2006.01)

(52) U.S. Cl.
CPC ..... *A44B 19/32* (2013.01)

(58) Field of Classification Search
CPC ..... A44B 19/32; A44B 19/06; A44B 19/346; B29D 5/00; B29D 5/02
See application file for complete search history.

(56) References Cited

U.S. PATENT DOCUMENTS 1,322,650 A * 11/1919 Sundback ..... A44B 19/34 206/810
1,403,988 A * 1/1922 Sundback ..... A44B 19/34 450/153
1,434,857 A * 11/1922 Sundback ..... B21D 53/50 29/418
2,070,753 A * 2/1937 Schatzky ..... A44B 19/26 24/417
2,511,414 A * 6/1950 Poux ..... A44B 19/34 2/265
2,623,214 A * 12/1952 Yaffe ..... A41H 37/003 2/265

(Continued)

FOREIGN PATENT DOCUMENTS

CN 201782133 U 4/2011
CN 107969769 A 5/2018

(Continued)

OTHER PUBLICATIONS

U.S. Appl. No. 17/544,681, filed Dec. 7, 2021.

(Continued)

*Primary Examiner* — David M Upchurch
(74) *Attorney, Agent, or Firm* — Siritzky Law, PLLC

(57) ABSTRACT

A waterproof zipper with at least one curve includes a first tape and a second tape, and interlocking elements attached to the first tape and the second tape, wherein the first tape and the second tape are curved, and wherein a curve of at least one of the tapes was caused by compaction of that tape. The zipper is coated on at least one side with a fluid impervious coating.

15 Claims, 14 Drawing Sheets

(56) References Cited

U.S. PATENT DOCUMENTS 2,909,823 A * 10/1959 Armstrong ..... B60J 1/1815 2/265
2,928,127 A 3/1960 Armstrong
3,003,212 A * 10/1961 Emery ..... A44B 19/34 139/384 B
3,389,441 A * 6/1968 Heimberger ..... A44B 19/32 24/389
3,490,109 A 1/1970 Heimberger
3,541,649 A 11/1970 Sim
3,551,962 A 1/1971 Uhrig
3,725,983 A * 4/1973 Selvaggi ..... A44B 19/34 139/384 B
3,964,150 A 6/1976 Moertel
3,990,130 A 11/1976 Hattori
4,025,277 A * 5/1977 Monroe ..... B29C 67/00 425/383
4,058,145 A 11/1977 Frohlich et al.
4,112,150 A 9/1978 Brown et al.
4,130,917 A 12/1978 Shopalovich
4,275,467 A 6/1981 Doelter
4,308,644 A 1/1982 Brown
4,312,102 A 1/1982 Fukuroi
4,348,789 A 9/1982 Brown
4,488,338 A 12/1984 Takahashi
4,502,190 A 3/1985 Inamura
4,513,482 A 4/1985 Fukuroi
4,524,493 A 6/1985 Inamura
4,580,321 A 4/1986 Tanikawa et al.
4,596,065 A 6/1986 Tanikawa et al.
4,601,085 A 7/1986 Yoshida et al.
4,604,775 A 8/1986 Kusayama
4,607,416 A 8/1986 Tanikawa et al.
4,607,425 A * 8/1986 Terasawa ..... A44B 19/34 29/408
4,658,480 A 4/1987 Morioka et al.
4,724,586 A 2/1988 Tsubokawa et al.
4,744,133 A 5/1988 Tsubata et al.
4,765,038 A 8/1988 Kasai
4,780,937 A 11/1988 Kusayama
4,817,252 A 4/1989 Kusayama
4,823,446 A 4/1989 Tsubata et al.
4,825,514 A 5/1989 Akeno
4,841,603 A 6/1989 Ragni
4,875,258 A 10/1989 Goedecke
4,888,859 A 12/1989 Horita
4,890,935 A 1/1990 Ausnit et al.
4,914,793 A 4/1990 Rampolia et al.
4,923,701 A 5/1990 VanErden
4,941,238 A 7/1990 Clark
4,942,648 A 7/1990 Yoshida
5,008,986 A 4/1991 Laudet et al.
5,020,194 A 6/1991 Herrington et al.
5,020,247 A 6/1991 Barret et al.
5,062,186 A 11/1991 Rampolia et al.
5,065,491 A * 11/1991 Takada ..... A44B 19/42 29/408
5,129,127 A 7/1992 Hamatani
5,231,736 A 8/1993 Hohenocker et al.
5,253,395 A 10/1993 Yano
5,293,672 A 3/1994 Tominaga et al.
5,351,369 A 10/1994 Swain
5,386,616 A 2/1995 Norvell
5,437,888 A 8/1995 Ortlieb
5,444,898 A 8/1995 Norvell
5,924,172 A 7/1999 Klein
5,991,980 A 11/1999 Meager
6,006,691 A 12/1999 Wilce
6,035,496 A 3/2000 Germani
6,092,266 A 7/2000 Lee
6,105,214 A 8/2000 Press
6,223,349 B1 5/2001 Roiser
6,343,408 B1 2/2002 Neugebauer
6,363,531 B1 4/2002 Quinn
6,363,553 B1 4/2002 Baumgartel et al.
6,427,294 B1 8/2002 Shibaike et al.
6,438,757 B1 8/2002 Quinn
6,497,014 B2 12/2002 Neugebauer
6,519,826 B1 2/2003 Ortlieb
6,571,432 B1 6/2003 Rindle
6,622,351 B2 9/2003 Takasawa
6,651,254 B1 11/2003 Chang
6,681,455 B2 1/2004 Ichikawa
6,691,326 B2 2/2004 Hexels
6,691,383 B2 2/2004 Linton
6,721,999 B2 4/2004 Meager
6,936,121 B2 8/2005 Butz
7,137,177 B2 11/2006 Fujii et al.
7,213,305 B2 5/2007 Stolmeier et al.
7,293,333 B2 11/2007 Stenhall
7,337,506 B2 3/2008 Kusayama et al.
7,392,572 B2 7/2008 Cossutti
7,416,397 B2 8/2008 Kusayama et al.
7,441,312 B2 10/2008 Bernasconi
7,500,291 B2 3/2009 Matsumoto
7,568,270 B2 8/2009 Cossutti
7,591,051 B2 9/2009 Kusayama et al.
7,624,482 B2 12/2009 Kusayama et al.
7,703,182 B2 4/2010 Bonaglia
7,832,065 B2 11/2010 Meager
7,934,305 B2 5/2011 Cossutti
7,954,209 B2 6/2011 Chen
8,011,070 B2 * 9/2011 Miyazaki ..... A44B 19/343 139/384 B
8,104,147 B2 1/2012 Peano
8,156,588 B2 4/2012 Svoboda
8,166,619 B2 5/2012 Cossutti et al.
8,327,509 B2 12/2012 Kusayama
8,375,528 B2 2/2013 Takazawa et al.
8,397,353 B2 3/2013 Chou
8,402,613 B2 3/2013 Williams et al.
8,438,706 B2 5/2013 Brightman
8,464,404 B2 6/2013 Takazawa et al.
8,484,810 B2 7/2013 Chou
8,646,156 B2 2/2014 Brightman
8,667,652 B2 3/2014 Thomas et al.
8,689,408 B2 4/2014 Chou
8,695,178 B2 4/2014 Yoneshima et al.
8,756,768 B2 6/2014 Williams et al.
8,806,724 B2 8/2014 Kusayama
8,869,356 B2 10/2014 Nir
8,938,860 B2 1/2015 Suckow et al.
9,015,908 B2 4/2015 Matsumoto et al.
9,055,790 B2 6/2015 Tanaka et al.
9,089,187 B2 7/2015 Takano et al.
9,138,033 B2 9/2015 Kojima et al.
9,173,458 B2 11/2015 Wang
9,237,781 B2 1/2016 Shimono
9,237,783 B2 1/2016 La Rocca et al.
9,247,791 B2 2/2016 Cowin et al.
9,265,308 B2 2/2016 Matsuda et al.
9,290,305 B2 3/2016 Stefanek et al.
9,295,307 B2 3/2016 Tominaga et al.
9,301,579 B2 4/2016 Fujii et al.
9,314,069 B2 4/2016 Takazawa
9,456,664 B2 10/2016 Tanaka
9,474,341 B2 10/2016 Chou
9,538,817 B2 1/2017 Ogura et al.
9,545,134 B1 1/2017 Tan
9,572,406 B2 2/2017 Tanaka et al.
9,622,551 B2 4/2017 Gonda et al.
9,642,420 B2 5/2017 McLachlan
9,661,902 B2 5/2017 Mikuma et al.
9,717,310 B1 8/2017 Chung
9,750,314 B2 9/2017 Ausnit et al.
9,756,879 B2 9/2017 Roup
9,840,037 B2 12/2017 Roup
9,872,522 B2 1/2018 Roup
9,888,748 B2 2/2018 Smith
9,896,241 B2 2/2018 Anzini et al.
9,955,741 B2 5/2018 Roup
10,016,027 B2 7/2018 Yoneoka
10,080,405 B2 9/2018 Cheng
10,130,149 B1 11/2018 Liping

(56) References Cited

U.S. PATENT DOCUMENTS

| | | | | |
|---|---|---|---|---|
| 10,144,160 | B2 | 12/2018 | Cheng | |
| 10,220,601 | B2 | 3/2019 | Roup et al. | |
| 10,264,858 | B2 | 4/2019 | Chen | |
| 10,285,457 | B2 | 5/2019 | Roup | |
| 10,362,839 | B2 * | 7/2019 | Minato | A44B 19/10 |
| 10,369,765 | B2 | 8/2019 | Konaka et al. | |
| 10,375,999 | B2 | 8/2019 | Roup | |
| 10,421,222 | B2 | 9/2019 | Cheng | |
| 10,426,233 | B2 | 10/2019 | Numata et al. | |
| 10,433,620 | B2 | 10/2019 | Kameyama et al. | |
| 10,464,252 | B2 | 11/2019 | Roup | |
| 10,492,572 | B1 | 12/2019 | Omote et al. | |
| 10,531,712 | B2 | 1/2020 | Ogura | |
| 10,562,247 | B2 | 2/2020 | Hsieh | |
| 10,575,599 | B2 | 3/2020 | Cheng | |
| 10,602,811 | B2 | 3/2020 | Adachi | |
| 10,602,812 | B2 | 3/2020 | Gordon | |
| 10,800,081 | B2 | 10/2020 | Chou | |
| 10,828,864 | B2 | 11/2020 | Roup et al. | |
| 10,863,801 | B2 | 12/2020 | Hosokawa et al. | |
| 10,959,497 | B2 | 3/2021 | Zhang | |
| 11,006,679 | B2 | 5/2021 | Roup | |
| 11,006,702 | B2 | 5/2021 | Martinson et al. | |
| 11,033,081 | B2 | 6/2021 | Myerscough et al. | |
| 11,034,130 | B2 | 6/2021 | Roup et al. | |
| 11,109,650 | B2 | 9/2021 | Martinson et al. | |
| 11,116,291 | B2 | 9/2021 | Myerscough et al. | |
| 11,134,756 | B2 | 10/2021 | Kayahara et al. | |
| 11,154,096 | B2 | 10/2021 | Roup | |
| 2001/0013158 | A1 | 8/2001 | Yamaguchi et al. | |
| 2002/0017010 | A1 | 2/2002 | Neugebauer | |
| 2004/0055069 | A1 * | 3/2004 | Clarke Fayle | A41D 3/00 2/93 |
| 2005/0235466 | A1 | 10/2005 | Segawa et al. | |
| 2006/0101632 | A1 | 5/2006 | Yang | |
| 2007/0214614 | A1 * | 9/2007 | Okot | A44B 19/265 24/432 |
| 2008/0248146 | A1 | 10/2008 | Yang | |
| 2008/0264335 | A1 | 10/2008 | Roup | |
| 2008/0268157 | A1 | 10/2008 | Roup | |
| 2009/0144948 | A1 * | 6/2009 | Jeon | A44B 19/06 24/403 |
| 2010/0125982 | A1 | 5/2010 | Chou | |
| 2011/0289738 | A1 * | 12/2011 | Wang | A44B 19/42 24/399 |
| 2012/0042433 | A1 | 2/2012 | Damon et al. | |
| 2013/0125351 | A1 | 5/2013 | Chou | |
| 2013/0125352 | A1 | 5/2013 | Chou | |
| 2013/0205548 | A1 * | 8/2013 | Wehner | A44B 19/32 112/475.16 |
| 2013/0232737 | A1 * | 9/2013 | Shimono | D03D 1/00 24/427 |
| 2014/0366336 | A1 * | 12/2014 | Chung | A44B 19/16 24/389 |
| 2015/0113697 | A1 | 4/2015 | Roup | |
| 2016/0113334 | A1 | 4/2016 | Roup | |
| 2016/0255920 | A1 | 9/2016 | La Rocca et al. | |
| 2016/0366949 | A1 | 12/2016 | Roup | |
| 2017/0127770 | A1 * | 5/2017 | Mert | A41D 31/00 |
| 2017/0253016 | A1 | 9/2017 | Roup et al. | |
| 2017/0367412 | A1 | 12/2017 | Roup | |
| 2018/0104887 | A1 | 4/2018 | Roup | |
| 2018/0140022 | A1 | 5/2018 | Roup | |
| 2018/0235291 | A1 | 8/2018 | Roup | |
| 2019/0335824 | A1 | 11/2019 | Roup | |
| 2019/0387808 | A1 | 12/2019 | Roup | |
| 2020/0114567 | A1 | 4/2020 | Roup | |
| 2020/0180263 | A1 | 6/2020 | Roup et al. | |
| 2021/0052017 | A1 | 2/2021 | Roup | |
| 2021/0101363 | A1 | 4/2021 | Roup et al. | |
| 2021/0204616 | A1 | 7/2021 | Roup | |
| 2021/0337888 | A1 | 11/2021 | Roup | |
| 2021/0362466 | A1 | 11/2021 | Roup et al. | |
| 2022/0104590 | A1 | 4/2022 | Roup et al. | |

FOREIGN PATENT DOCUMENTS

| | | | |
|---|---|---|---|
| DE | 7122407 | U | 9/1971 |
| JP | 4472851 | B2 | 4/2002 |
| WO | 2006000086 | A2 | 1/2006 |
| WO | 2017117285 | A1 | 7/2017 |
| WO | 2021/100021 | | 5/2021 |

OTHER PUBLICATIONS

PCT/IB2020/061005, Nov. 22, 2020.

WIPO, Written Opinion of the International Searching Authority for PCT/IB2020/061005, dated May 27, 2021 (15 pgs.).

WIPO, International Search Report for PCT/IB2020/061005, dated May 27, 2021 (5 pgs.).

WIPO, International Search Report (ISR) for PCT/IB2022/058677, dated Dec. 16, 2022.

WIPO, Written Opinion of International Search Authority (WO) for PCT/IB2022/058677, dated Dec. 16, 2022.

* cited by examiner

FIG. 4A
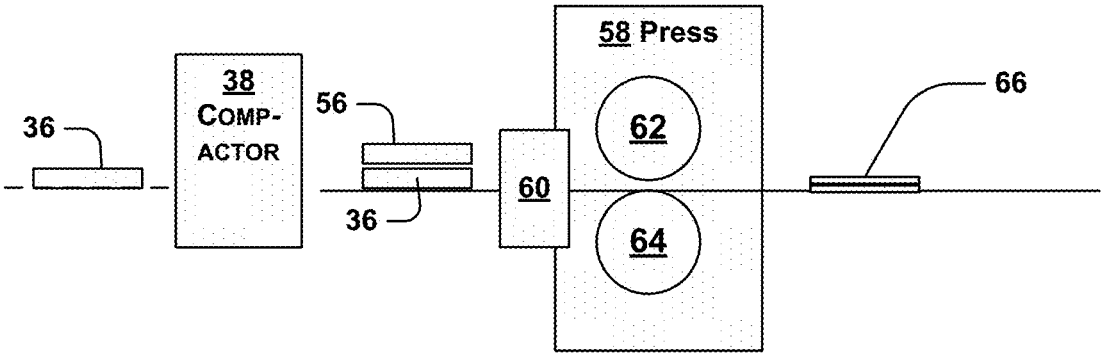
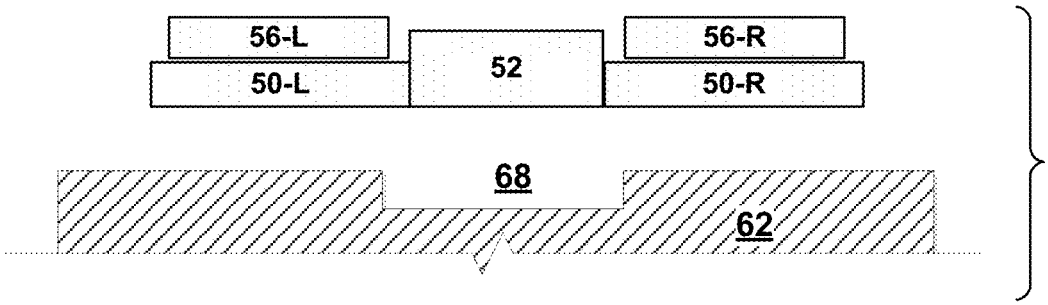
FIG. 4B

FIG. 7A
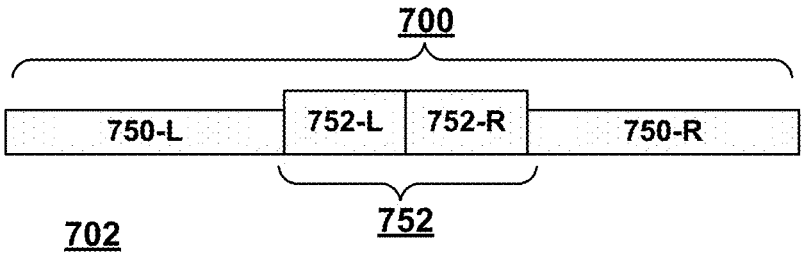
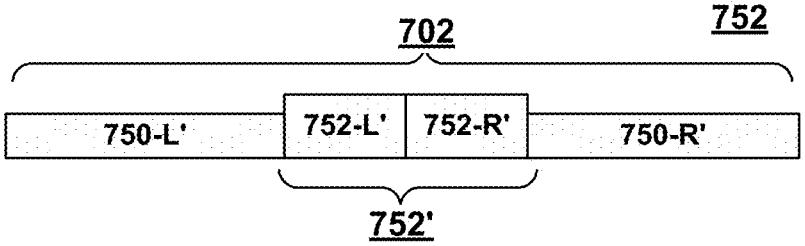
FIG. 7B
FIG. 7C
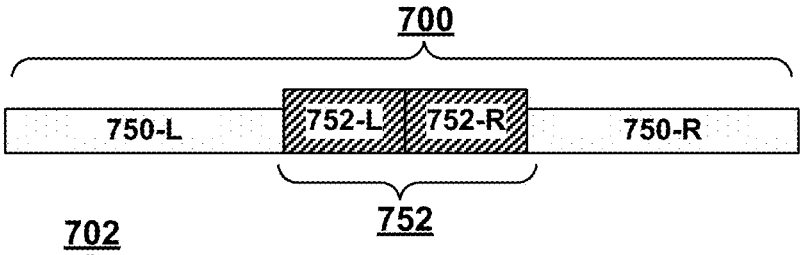
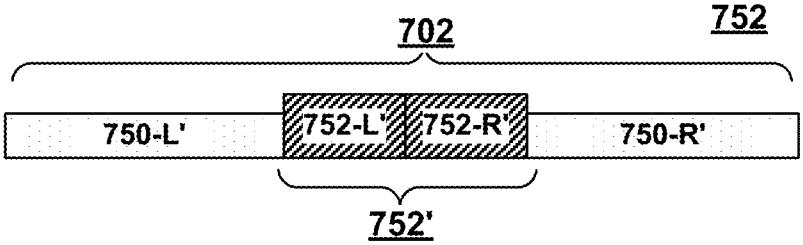
FIG. 7D
FIG. 7E
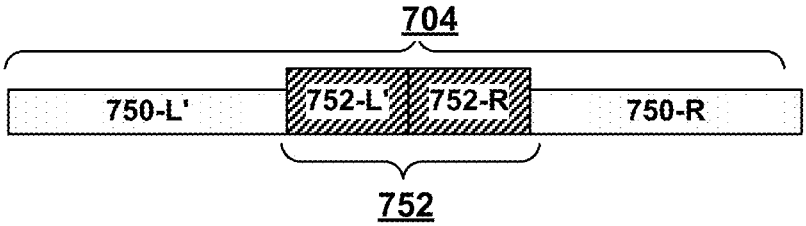
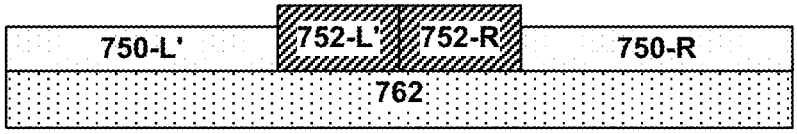
FIG. 7F
FIG. 7G
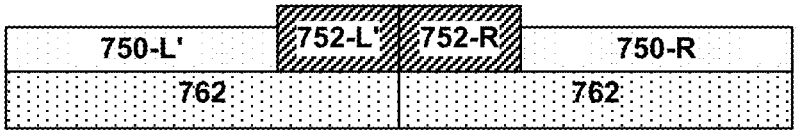
FIG. 7H
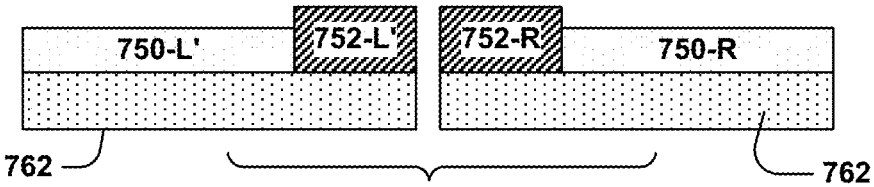

METHODS OF MAKING WATERPROOF CURVED ZIPPERS

RELATED APPLICATIONS

This application is a divisional of Ser. No. 17/539,570, filed Dec. 1, 2021, which is a continuation-in-part (CIP) of PCT/IB2020/061005, filed Nov. 23, 2020, which claims the benefit of U.S. provisional patent application No. 62/939,590, filed Nov. 23, 2019, the entire contents of each of which are hereby fully incorporated herein by reference for all purposes. application Ser. No. 17/539,570 claims the benefit of U.S. provisional patent application No. 63/246,641, filed Sep. 21, 2021. This application claims the benefit of U.S. provisional patent application No. 63/246,641, filed Sep. 21, 2021, the entire contents of which are hereby fully incorporated herein by reference for all purposes.

COPYRIGHT STATEMENT

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD

This invention relates generally to zippers and, more particularly, in some aspects, to waterproof curved zippers.

BACKGROUND

Zippers (or slide fasteners) are ubiquitous and have long been used to fasten or otherwise secure items such as jackets, luggage, pockets, and other types of items/products.

While conventional zippers are straight, it is desirable to have a curved zipper that can effectively track a curved path of an item. Exemplary curved zippers are shown in PCT/IB2020/061005, titled "Curved Zipper," published May 27, 2021, as WO/2021/100021, the entire contents of which are hereby fully incorporated herein by reference for all purposes.

It is further desirable and an object hereof to provide waterproof zippers, particularly waterproof curved zippers.

SUMMARY

The present invention is specified in the claims as well as in the below description. The following summary is exemplary and not limiting. Presently preferred embodiments are particularly specified in the dependent claims and the description of various embodiments.

One general aspect includes a zipper (or slide fastener) having a first tape and a second tape. The zipper also includes interlocking elements attached to the first tape and to the second tape, where at least a portion of the first tape and at least a corresponding portion of the second tape are curved. The zipper also includes where at least curved portions of the first tape and corresponding curved portions of the second tape are asymmetric about the interlocking elements. The zipper also includes where there is TPU (thermoplastic polyurethane) between the interlocking elements. The zipper also includes where the first tape, the second tape, and the interlocking elements are coated with a fluid-impervious film or coating. The zipper also includes where a curve of the first tape was caused by compaction of the first tape.

Implementations or embodiments may include one or more of the following features, alone and/or in combination(s):

- The zipper is waterproof or substantially waterproof
- The zipper where the zipper has more than one curve.
- Multiple portions of the first tape and corresponding multiple portions of the second tape are curved.
- At least a portion of the first tape has a different degree of curvature than a corresponding curved portion of the second tape.
- At least a portion of the first tape has a different degree of compaction than a corresponding curved portion of the second tape.
- At least a portion of the first tape has a different width than a corresponding portion of the second tape.
- A curved portion of the first tape has a first radius of curvature, and where a corresponding curved portion of the second tape has a second radius of curvature, distinct from the first radius of curvature.
- A second curved portion of the first tape has a third radius of curvature, and where a corresponding second curved portion of the second tape has a fourth radius of curvature, distinct from the third radius of curvature.
- The first radius of curvature is distinct from the third radius of curvature.
- A curve of the first tape was caused, at least in part, by compaction of the first tape.
- At least a curved portion of the first tape was compacted using a compactor.
- The first tape is woven with a first edge portion having a tighter weave than the rest of the first tape.
- The second tape is woven with a second edge portion having a tighter weave than the rest of the second tape.
- Interlocking elements were attached to the first tape before the first tape was curved.
- Interlocking elements were attached to the second tape before the second tape was curved.
- At least a curved portion of the first tape has stretch and recovery properties.
- At least a curved portion of the first tape is fused with a fusible substrate.
- The fluid-impervious film or coating was applied to the first tape and the second tape, and the interlocking elements after the first tape and the second tape were curved.
- The waterproof zipper includes a cut in the fluid-impervious film or coating along a path of the interlocking elements, the cut allowing the interlocking elements and corresponding portions of the first tape and the second tape to be separated.

Another general aspect includes an item or product, including a waterproof zipper. The item or product may be selected from: a garment, footwear (e.g., rain boots, work boots, hiking boots), an item of luggage, an item of sports equipment, boat covers, bags, pencil cases, camping equipment (e.g., tents), uniforms, snow gear, athletic wear, wetsuits, dive duffel bags, fishing clothing, backpacks, computer/laptop cases, luggage, zip-up portfolio case, zip-up storage bins for toys, sleeping bags, tents, children make up/toiletry bags, lunch bags, hats with zipper pockets, toys, toy clothing, a handbag, and others.

Implementations or embodiments may include one or more of the following features, alone and/or in combination(s):

The item wherein the zipper is attached to the item by stitching and/or welding and/or gluing.

The item wherein the zipper is attached to the item by stitching that uses a thread that swells when wet.

The item wherein the zipper is waterproof or substantially waterproof, and wherein additional structure is added to the item to cover at least a part of the zipper to maintain waterproofing of the item.

Another general aspect includes a method including providing a zipper with a left tape and a right tape connected to a rail of interlocking elements. The method further includes, with the interlocking elements interlocked, putting TPU or the like between the interlocking elements. The method further includes compacting the left tape and the right tape and forming at least one curve in the zipper. The method further includes coating one or both sides of the zipper with a fluid-impervious film or coating. The method further includes scoring the fluid-impervious film or coating along the rail.

Implementations or embodiments may include one or more of the following features, alone and/or in combination(s):

at least a curved portion of the left tape and a corresponding curved portion of the right tape are asymmetric about the interlocking elements.

TPU or the like is put between the interlocking elements after the compacting.

after compacting, the zipper has more than one curve.

the provided zipper is straight.

TPU or the like is put between the interlocking elements by being blown and/or injected into the interlocking elements under pressure.

the fluid-impervious film or coating is applied in the form of an adhesive strip.

the fluid-impervious film or coating is scored substantially along the center of the rail.

Another general aspect includes a method including providing (a) a first zipper with a first left tape and a first right tape connected to a first rail of first interlocking elements, and (b) a second zipper with a second left tape and a second right tape connected to a second rail of second interlocking elements. The method further includes compacting the first left tape and the first right tape, and compacting the second left tape and the second right tape. The method further includes forming a third zipper from the left first tape and the right second tape. The method further includes, with the interlocking elements of the third zipper interlocked, putting TPU or the like between the interlocking elements of the third zipper. The method further includes curving the third zipper to form at least one curve in the third zipper; and then coating one or both sides of the third zipper with a fluid-impervious coating or film. The method further includes scoring the fluid-impervious coating or film along the rail of the third zipper.

Implementations or embodiments may include one or more of the following features, alone and/or in combination(s):

The method where the first left tape and/or the first right tape are compacted with a first compaction, and where the second left tape and/or the second right tape are compacted with a second compaction.

wherein the zipper is curved before putting TPU between the interlocking elements.

wherein, for the third zipper, at least a curved portion of the left first tape and a corresponding curved portion of the right second tape are asymmetric about the interlocking elements.

wherein the third zipper has more than one curve.

wherein the first zipper is straight, and the second zipper is straight.

wherein TPU is blown and/or injected under pressure into the first interlocking elements and into the second interlocking elements.

wherein the coating or film is applied in the form of an adhesive strip.

Another general aspect includes a method including providing (a) a first zipper with a first left tape and a first right tape connected to a first rail of first interlocking elements, and (b) a second zipper with a second left tape and a second right tape connected to a second rail of second interlocking elements. The method further includes, with the first interlocking elements of the first zipper interlocked, putting TPU between the first interlocking elements; and with the second interlocking elements of the second zipper interlocked, putting TPU between the second interlocking elements. The method further includes compacting the first left tape and the first right tape and compacting the second left tape and the second right tape. The method further includes forming a third zipper from the left first tape and the right second tape. The method further includes curving the third zipper to form at least one curve in the third zipper. The method further includes coating one or both sides of the third zipper with fluid-impervious coating or film; and then scoring the fluid-impervious coating or film along the rail of the third zipper.

Implementations or embodiments may include one or more of the following features, alone and/or in combination(s):

The method where the first left tape and/or the first right tape are compacted with a first compaction, and where the second left tape and/or the second right tape are compacted with a second compaction.

for the third zipper, at least a curved portion of the left first tape and a corresponding curved portion of the right second tape are asymmetric about the interlocking elements.

the third zipper has more than one curve.

Initially the first and second zippers are straight.

TPU is put between the interlocking elements by being blown and/or injected under pressure into the first interlocking elements and into the second interlocking elements.

the coating or film is applied in the form of an adhesive strip.

the coating or film is scored substantially along the center of the rail.

Below is an exemplary list of zipper embodiments. The zipper embodiments will be indicated with a letter "Z". Whenever such embodiments are referred to, this will be done by referring to "Z" embodiments.

Z1. A zipper comprising:

a first tape and a second tape; and interlocking elements attached to the first tape and to the second tape, wherein at least a portion of the first tape and at least a corresponding portion of the second tape are curved, and wherein at least curved portions of the first tape and corresponding curved portions of the second tape are asymmetric about the interlocking elements, and wherein there is TPU between the interlocking elements, and wherein the first tape and the second tape and the interlocking elements are coated with a fluid-impervious film, and wherein a curve of the first tape was caused by compaction of the first tape.

Z2. The zipper of any of the zipper embodiments, wherein the zipper has more than one curve.

Z3. The zipper of any of the zipper embodiments, wherein multiple portions of the first tape and corresponding multiple portions of the second tape are curved.

Z4. The zipper of any of the zipper embodiments, wherein at least a portion of the first tape has a different degree of curvature than a corresponding curved portion of the second tape.

Z5. The zipper of any of the zipper embodiments, wherein a curved portion of the first tape has a first radius of curvature, and wherein a corresponding curved portion of the second tape has a second radius of curvature, distinct from the first radius of curvature.

Z6. The waterproof zipper of any of the zipper embodiments, wherein a second curved portion of the first tape has a third radius of curvature, and wherein a corresponding second curved portion of the second tape has a fourth radius of curvature, distinct from the third radius of curvature.

Z7. The zipper of any of the zipper embodiments, wherein the first radius of curvature is distinct from the third radius of curvature.

Z8. The zipper of any of the zipper embodiments, wherein a curve of the first tape was caused, at least in part, by compaction of the first tape.

Z9. The zipper of any of the zipper embodiments, wherein at least a curved portion of the first tape was compacted using a compactor.

Z10. The zipper of any of the zipper embodiments, wherein at least a portion of the first tape has a different degree of compaction than a corresponding curved portion of the second tape.

Z11. The zipper of any of the zipper embodiments, wherein at least a portion of the first tape has a different width than a corresponding portion of the second tape.

Z12. The zipper of any of the zipper embodiments, wherein the first tape is woven with a first edge portion having a tighter weave than the rest of the first tape.

Z13. The zipper of any of the zipper embodiments, wherein the second tape is woven with a second edge portion having a tighter weave than the rest of the second tape.

Z14. The zipper of any of the zipper embodiments, wherein interlocking elements were attached to the first tape before the first tape was curved.

Z15. The zipper of any of the zipper embodiments, wherein interlocking elements were attached to the second tape before the second tape was curved.

Z16. The zipper of any of the zipper embodiments, wherein at least a curved portion of the first tape has stretch and recovery properties.

Z17. The zipper of any of the zipper embodiments, wherein at least a curved portion of the first tape is fused with a fusible substrate.

Z18. The zipper of any of the zipper embodiments, wherein said fluid-impervious film was applied to the first tape and the second tape and the interlocking elements after the first tape and the second tape were curved.

Z19. The zipper of any of the zipper embodiments, including a cut in the fluid-impervious film along a path of the interlocking elements, said cut allowing the interlocking elements and corresponding portions of the first tape and the second tape to be separated.

Z20. The zipper of any of the zipper embodiments, wherein the zipper is waterproof or substantially waterproof.

Below are process embodiments indicated with the letter "P".

P21. A process comprising:

(A) providing a zipper with a left tape and a right tape connected to a rail of interlocking elements;

(B) with the interlocking elements interlocked, putting TPU between the interlocking elements;

(C) compacting the left tape and the right tape and forming at least one curve in the zipper; and then (D) coating one or both sides of the zipper with fluid-impervious coating or film; and then (E) scoring the fluid-impervious coating or film along the rail.

P22. The process of any of the process embodiments P21-P27, wherein TPU is put between the interlocking elements in (B) after the compacting in (C).

P23. The process of any of the process embodiments P21-P27, wherein at least a curved portion of the left tape and a corresponding curved portion of the right tape are asymmetric about the interlocking elements.

P24. The process of any of the process embodiments P21-P27, wherein, after compacting, the zipper has more than one curve.

P25. The process of any of the process embodiments P21-P27, wherein, in (A), the zipper is straight.

P26. The process of any of the process embodiments P21-P27, wherein the TPU is blown and/or injected into the interlocking elements under pressure.

P27. The process of any of the process embodiments P21-P27, wherein the coating or film is applied in the form of an adhesive strip.

P28. A method comprising:

(A) providing (a) a first zipper with a first left tape and a first right tape connected to a first rail of first interlocking elements, and (b) a second zipper with a second left tape and a second right tape connected to a second rail of second interlocking elements;

(B) compacting the first left tape and/or the first right tape with a first compaction, and compacting the second left tape and/or the second right tape with a second compaction; and (C) forming a third zipper from the left first tape and the right second tape;

(D) with the interlocking elements of the third zipper interlocked, putting TPU between the interlocking elements of the third zipper;

(E) curving the third zipper to form at least one curve in the zipper; and then (F) coating one or both sides of the third zipper with fluid-impervious coating or film; and then (G) scoring the fluid-impervious coating or film along the rail of the third zipper. P29. The process of any of the process embodiments P28-P34 wherein the zipper is curved in (E) before putting TPU between the interlocking elements.

P30. The process of any of the process embodiments P28-P34, wherein, for the third zipper, at least a curved portion of the left first tape and a corresponding curved portion of the right second tape are asymmetric about the interlocking elements.

P31. The process of any of the process embodiments P28-P34, wherein the third zipper has more than one curve.

P32. The process of any of the process embodiments P28-P34, wherein, in (A), the first zipper is straight, and the second zipper is straight.

P33. The process of any of the process embodiments P28-P34, wherein, in (D), the TPU is blown and/or injected under pressure into the first interlocking elements and into the second interlocking elements.

P34. The process of any of the process embodiments P28-P33, wherein, in (F), the coating is applied in the form of an adhesive strip.

P35. A method comprising:

(A) providing (a) a first zipper with a first left tape and a first right tape connected to a first rail of first interlocking elements, and (b) a second zipper with a second left tape and a second right tape connected to a second rail of second interlocking elements;

(B) with the first interlocking elements of the first zipper interlocked, putting TPU between the first interlocking elements; and with the second interlocking elements of the second zipper interlocked, putting TPU between the second interlocking elements;

(C) compacting the first left tape and the first right tape with a first compaction, and compacting the second left tape and the second right tape with a second compaction;

(D) forming a third zipper from the left first tape and the right second tape;

(E) curving the third zipper formed in (D) to form at least one curve in the zipper; and then (F) coating one or both sides of the third zipper with fluid-impervious coating; and then (G) scoring the fluid-impervious coating along the rail of the third zipper.

P35A. The process of any of the process embodiments P35-P35E, wherein, for the third zipper, at least a curved portion of the left first tape and a corresponding curved portion of the right second tape are asymmetric about the interlocking elements.

P35B. The process of any of the process embodiments P35-P35E, wherein the third zipper has more than one curve.

P35C. The process of any of the process embodiments P35-P35E, wherein, in (A), the first zipper is straight, and the second zipper is straight.

P35D. The process of any of the process embodiments P35-P35E, wherein the TPU is blown and/or injected under pressure into the first interlocking elements and into the second interlocking elements.

P35E. The process of any of the process embodiments P35-P35D, wherein, in (F), the coating is applied in the form of an adhesive strip.

Below are item/product embodiments indicated with the letter "I".

136. An item or product comprising a zipper according to any of the zipper embodiments Z1-Z20.

137. The item or product of any of the item embodiments, wherein the zipper is attached to the item by stitching and/or welding and/or gluing.

138. The item or product of any of the item embodiments, wherein the stitching uses a thread that swells when wet.

139. The item or product of any of the item embodiments, wherein the zipper is waterproof or substantially waterproof, and wherein additional structure is added to the item to cover at least a part of the zipper to maintain waterproofing of the item.

140. The item or product of any of the item embodiments, wherein the product is selected from: a garment, footwear (e.g., rain boots, work boots, hiking boots), an item of luggage, an item of sports equipment, boat covers, bags, pencil cases, camping equipment (e.g., tents), uniforms, snow gear, athletic wear, wetsuits, dive duffel bags, fishing clothing, backpacks, computer/laptop cases, luggage, zip-up portfolio case, zip-up storage bins for toys, sleeping bags, tents, children make up/toiletry bags, lunch bags, hats with zipper pockets, toys, toy clothing, a handbag.

141. The item or product of any of the item embodiments 136-140 including a zipper made by any of the process embodiments P21-P35E.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIGS. 3A-3B and 4A-4B depict aspects of forming waterproof curved zippers according to exemplary embodiments hereof;

FIGS. 6A-6H, 7A-7K, and 8A-8B depict aspects of making waterproof curved zippers according to exemplary embodiments hereof.

DETAILED DESCRIPTION OF THE PRESENTLY PREFERRED EXEMPLARY EMBODIMENTS

Zippers according to exemplary embodiments hereof are described here.

The following detailed description is not intended to limit the current invention. Alternate embodiments and variations of the subject matter described herein will be apparent to those skilled in the art.

Background

Figure 1:
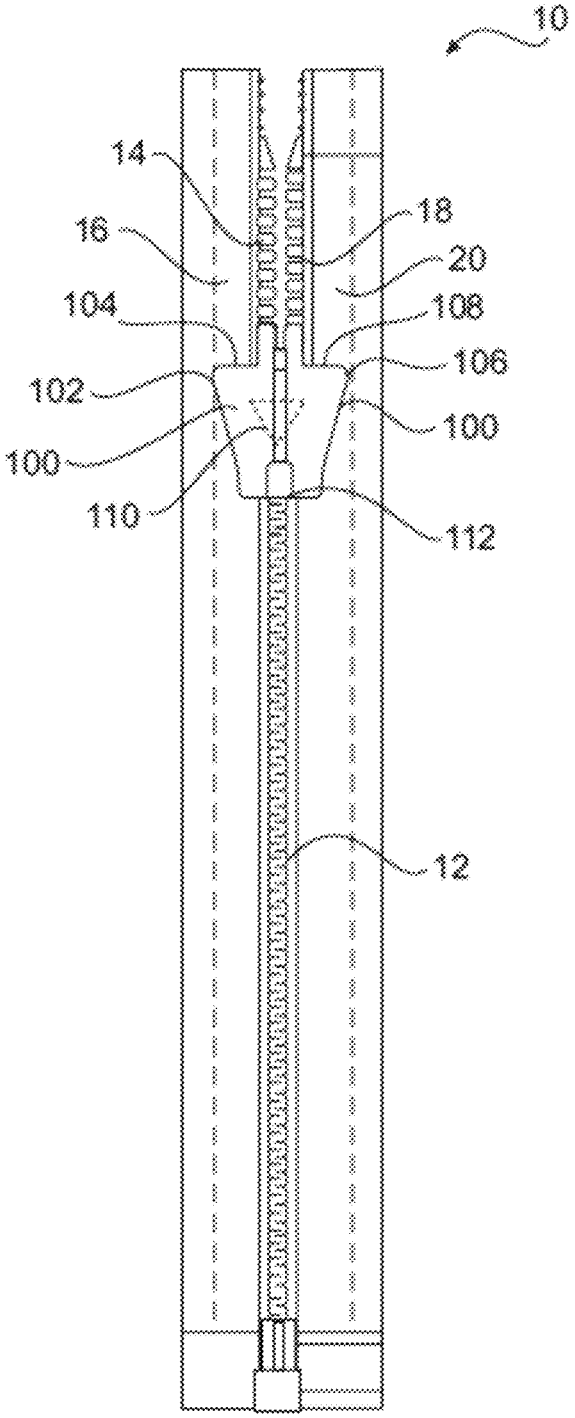
FIG. 1 (PRIOR ART)
FIG. 1 shows aspects of a conventional zipper.

As shown in FIG. 1, and as is well known, a zipper 10 (also referred to as a zipper assembly) includes a zipper chain 12 comprising two individual rows of interlocking elements, e.g., teeth or coils or the like (left row of teeth 14 attached to left tape 16 and the right row of teeth 18 attached to right tape 20) that, when interlocked, may form the combined zipper chain 12. A slider 100 may be configured and positioned such that the left row of teeth 14 pass into and through a left-side channel 102 in the slider's top left shoulder 104, and the right row of teeth 18 pass into and through a right-side channel 106 of the slider's top right shoulder 108.

The left and right side channels 102, 106 may combine below piece 110 within the body cavity of slider 100 (generally hidden from view and depicted with dashed lines in FIG. 1) to form a mouth 112. In operation, and as is known, as the left row of teeth 14 and the right row of teeth 18 pass through mouth 112, they may interlock to form zipper chain 12.

As is also well known, the slider 100 may be moved from one end of the zipper to the other. As the slider is moved in one direction, the rows of teeth (the left row of teeth 14 and right row of teeth 18) may continue to be interlocked as they pass through slider 100 to form the length of the combined zipper chain 12. As slider 100 is moved in the other direction, it may contact the joined zipper chain 12 at a junction between the left row of teeth 14 and the right row of teeth 18 to force them apart, separate them from one another, and generally unlock the two rows of teeth 14, 18. This separation and unlocking may result in two separate and individual rows of teeth 14, 18. This allows zipper chain 12 to be combined to fasten the left and right sides together and separated to unfasten them. In this way, the zipper 10 may be used as a fastener for jackets, pockets, luggage, and other products.

The interlocking elements may be connected directly to the left and right tapes (e.g., in the case where they are metal teeth or the like), or they may be attached to a separate chain which is then attached to the left and right tapes.

Description

Curved zippers (i.e., zippers having at least one curved portion) may be formed, e.g., as described in PCT/IB2020/061005, titled "Curved Zipper," published as WO/2021/100021 on May 27, 2021, the entire contents of which are fully incorporated herein by reference for all purposes.

In order to make zippers that curve according to exemplary embodiments hereof, the zipper tapes may be curved with or without the teeth elements attached to the tapes.

Figure 2C:
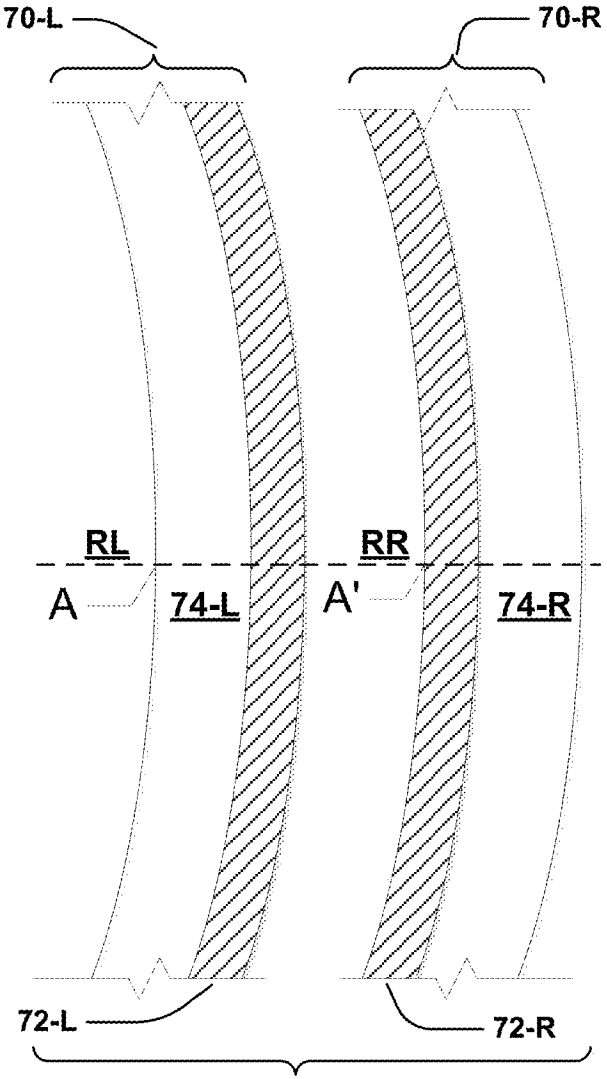
FIGS. 2A-2F show aspects of zippers and making zippers according to exemplary embodiments hereof.
Figure 2B:
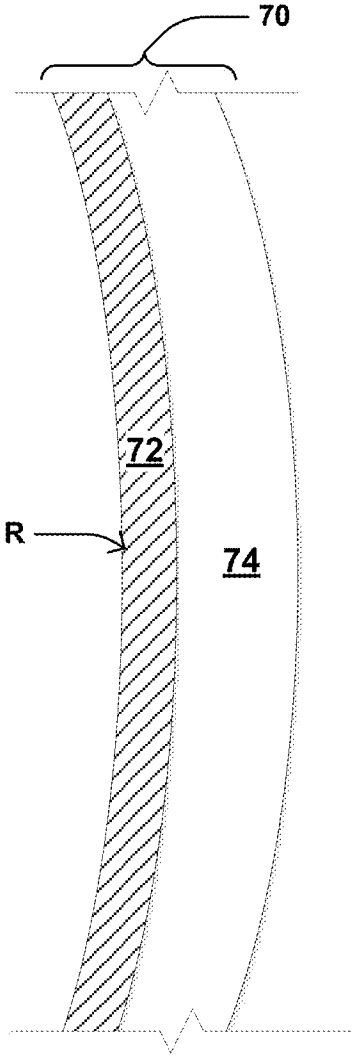
Figure 2A:
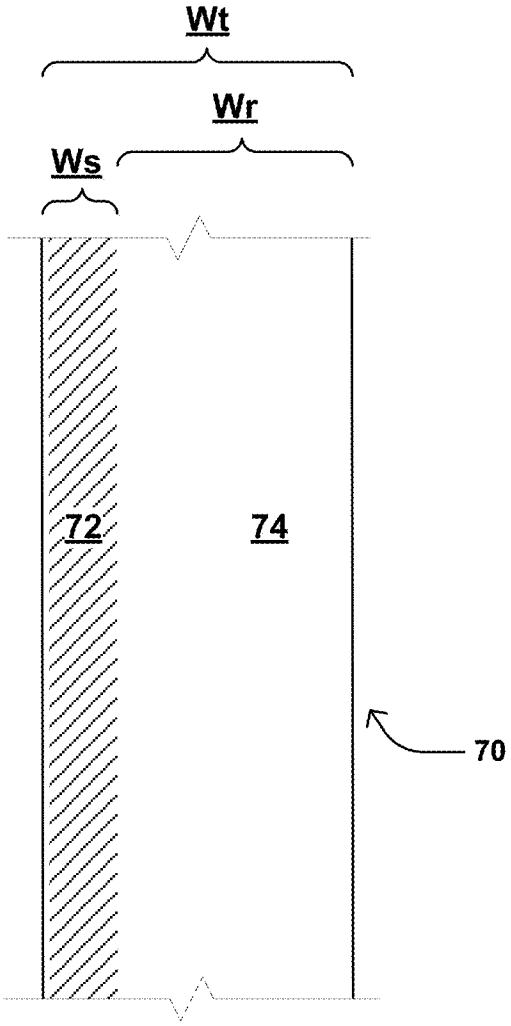

In some cases, e.g., as shown in FIG. 2A, the tape 70 may be woven with a self-edge 72 (shaded in the drawing in FIG. 2A) that has a tighter weave than the rest of the tape 74. The self-edge 72 is the edge to which teeth elements are or will be attached.

The self-edge 72 has a width Ws, and the rest of the tape has a width Wr, where Wt=Ws+Wr is the width of the tape. Those of skill in the art will know and understand, upon reading this description, how to select the ratio of Ws to Wr (or of Ws to Wt) to achieve a desired curvature for the zipper. For example, the width Wr will affect the amount of compaction of that portion of the tape.

The widths Ws and Wr and Wt (of the tape) could be the same or different on the left and right tapes. In some cases, Wt is the same on both the left and right tapes, but the widths Ws and Wr differ. In other cases, Wt is different on the left and right tapes. As shown in the example in FIG. 2F, the left tape 70-L has width Wtl=Wsl+Wrl, and the right tape 70-R has a width Wtr=Wrr+Wsr. E.g., the widths of the left and right tapes may differ (e.g., Wtl≠Wtr). The widths of the self edges (72-L, 72-R) Wsl, Wsr are preferably the same but may differ. The widths Wrl and Wrr of the rest of the tapes 74-L, 74-R (the part of the tape without the self edges) may differ (e.g., Wrl≠Wrr).

The tape 70 may be compacted using a heated compactor. Since the self-edge has a tighter weave than the rest of the tape, when compacted, the self-edge 72 will compact less than the rest of tape 74. Thus, after compaction, the rest of the tape 74 will open up more than the self-edge 72. This will cause the tape 70 to curve, e.g., as shown in FIG. 2B. The curved portion of tape 70 shown in FIG. 2B has a radius of curvature denoted R in the drawing.

As shown, e.g., in FIG. 2C, the tapes 70-L, 70-R for the left and right sides of a zipper should be curved so that the outside edge of one side has tighter compaction than the rest of that side, and, for the other tape side, the inside edge has tighter compaction than the rest of the tape.

The curved portion of tape 70-L shown in FIG. 2C has a radius of curvature (at point A) denoted RL in the drawing, while the corresponding curved portion of tape 70-R shown in FIG. 2C has a radius of curvature (at point A', corresponding to point A) denoted RR. The two curves may have different radii of curvature (e.g., as shown in FIG. 2D). That is, in some cases, RL≠RR. Note that in the drawing in FIG. 2D, the left tape is shown narrower than the right tape. As discussed herein, the left and right tapes may have the same width or different widths.

As used herein, the term "radius of curvature" for a curve at a point may be the radius of a circular arc that best approximates the curve at that point. Thus, for a curved portion of a tape, the radius of curvature at a point on that curved portion may be the radius of the circular arc which best approximates the curve at that point on the tape. For two tapes (a first tape and a second tape (e.g., a left tape and a right tape)), a first point or location of the first tape corresponds to a second point or location of the second tape if an interlocking element (e.g., a tooth) at the first point or location on the first tape connects to a corresponding interlocking element (e.g., a tooth) at the second point or location on the second tape. As used herein, a first portion of a first tape corresponds to a second portion of a second tape if the interlocking elements (e.g., teeth) in the first portion of the first tape connect to corresponding teeth in the second portion of the second tape.

The left and right tapes 70-L and 70-R may have different degrees of compaction. In general, the left tape 70-L may have CL percent compaction, while the right tape 70-R may have CR percent compaction, where, in some cases, CL≠CR. For example, without limitation, the left tape 70-L may have 5 percent compaction while the right tape 70-R may have 15 percent compaction.

Figure 2E:
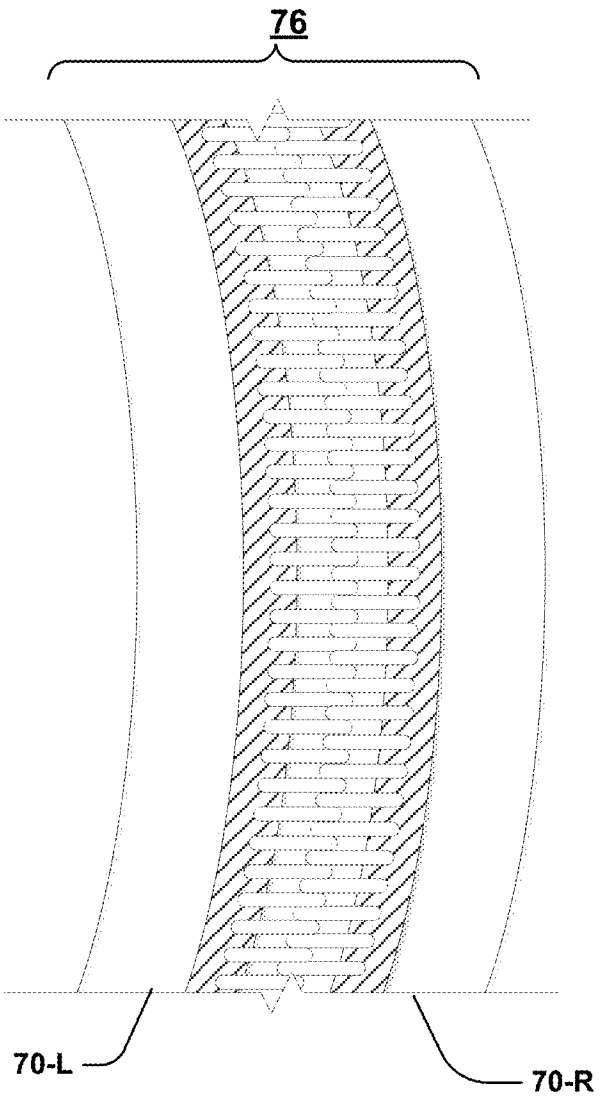
Figure 2D:
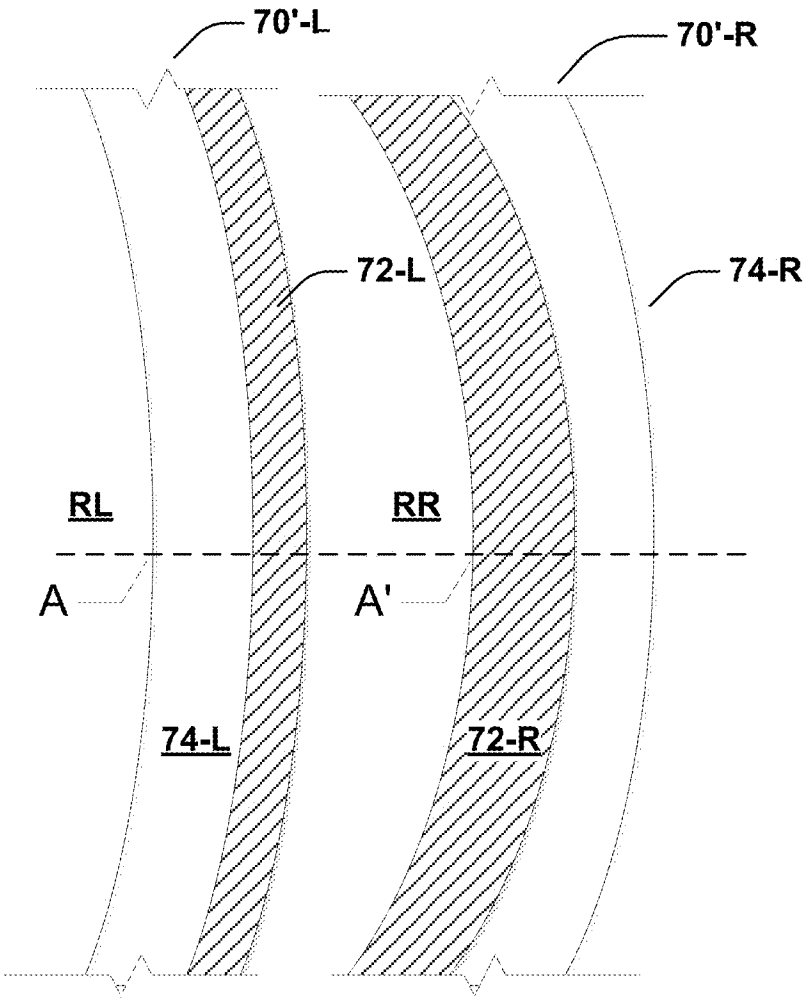
Figure 2F:
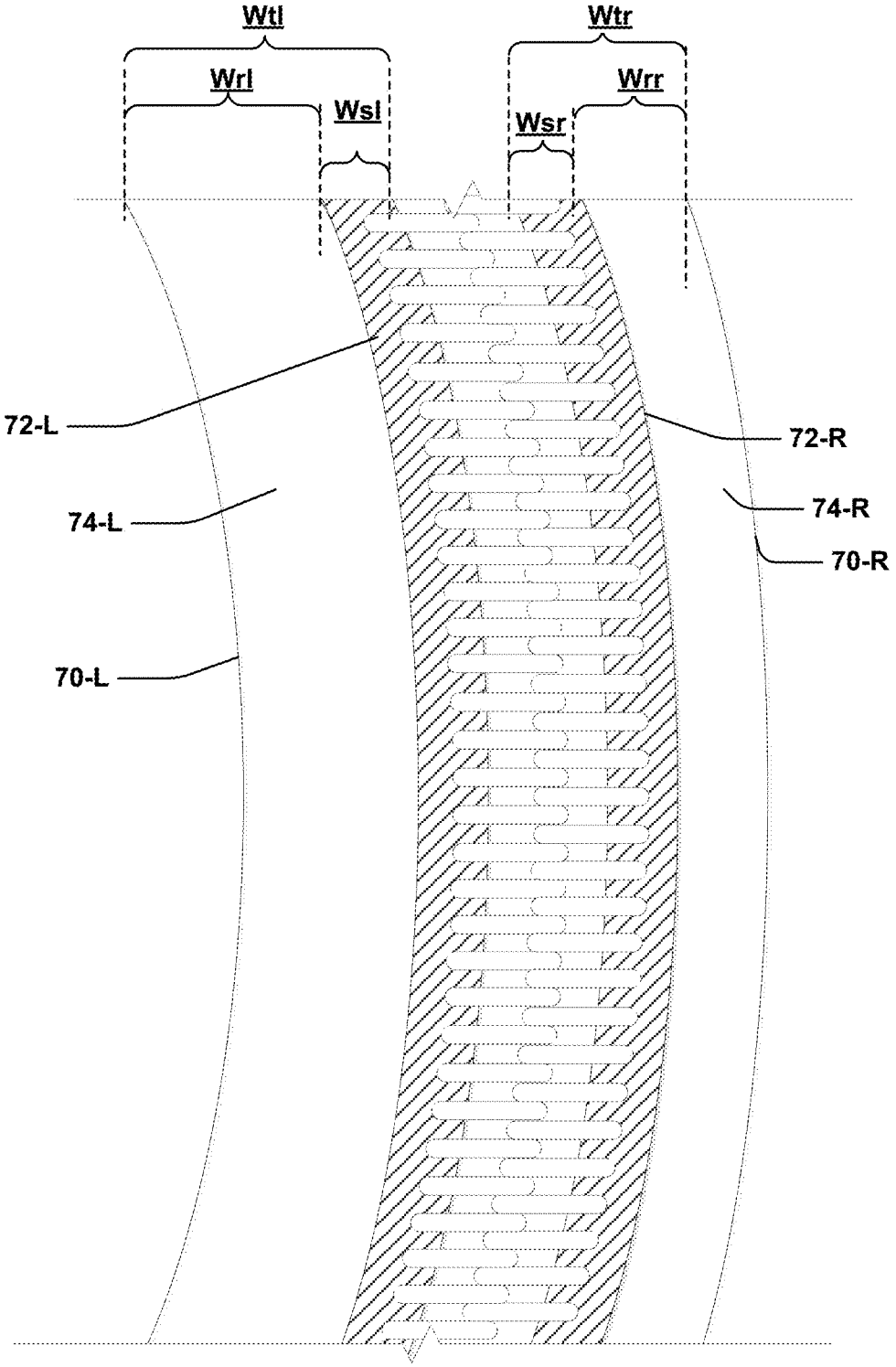

The two curved tapes 70-L, 70-R, joined with/by their interlocking elements (e.g., teeth), as shown in FIG. 2E, form a curved zipper 76.

FIGS. 2A-2E show only a portion of a curved tape or curved zipper. As should be understood, other parts of the zipper may be straight or may also be curved. Different parts of a zipper may have different degrees of curvature. A zipper may have multiple curves. In some cases, tapes with different curvatures may be joined (e.g., sewn together) to form a zipper with multiple curvatures. The two tapes may have been formed or compacted separately. For example, a first zipper with a first curvature may be formed (as described above), and a second zipper with a second curvature may be formed (also as described above). Then a tape from the first zipper (having the first curvature) may be used with a tape of the second zipper (having the second curvature). Generally, as used herein, the term "curved zipper" means a zipper having at least one curved portion.

As should be appreciated, for curved portions of a curved zipper, corresponding curved portions of the tapes (left and right tapes) are asymmetric about the interlocking elements, whereas for straight portions of a zipper, the tapes are symmetric about the interlocking elements.

If the tapes 70-L, 70-R are compacted with a drum, the tapes may be processed on opposite sides of the drum before being joined with the teeth.

The zipper may be formed with pre-compacted or uncompacted tapes, and then the fully formed zipper may be compacted.

Figure 3A:
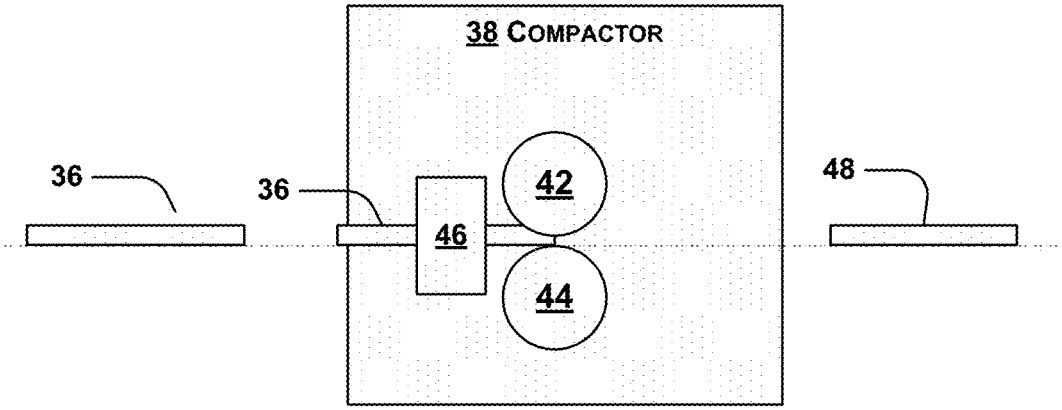

An exemplary approach to compacting the zippers is shown in FIG. 3A, in which assembled zippers 36 (with interlocking elements (e.g., teeth) attached to tapes) are fed into a compactor 38. The compactor 38 may include one or two drums 42, 44. The top drum 42 is preferably rubber, while the bottom drum 44 is preferably steel. Since the zipper 36 is already at least partially assembled, one or both of the drums 42, 44 may be cut or grooved to allow the zipper's rail (interlocking elements, e.g., teeth) to pass through uncompacted, while the tapes on either side of the rail are compacted.

Figure 3B:
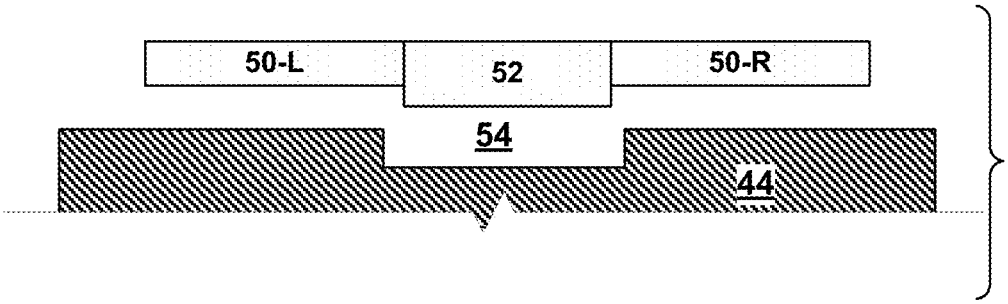

As shown in FIG. 3B, a zipper includes a left tape 50-L and a right tape 50-R, connected to the rail or interlocking elements 52. As noted, to prevent compaction of the interlocking elements 52, the drum 44 may include a notch or groove or cut 54 to allow the interlocking elements 52 to pass through uncompressed. A similar notch or the like may be incorporated into the drum 42, in which case the zippers 36 may be fed into the compactor 38 with the interlocking elements facing up or down.

One or both of the drums 42, 44 may be grooved and/or coated, at least in the regions that will come into contact with the tapes.

The compactor 38 may include a suitable guide mechanism 46 to position the zippers correctly and accurately 36 as the pass between the drums 42, 44.

In order to achieve compaction of the zippers 36, one or both of the drums may be heated. Those of skill in the art will understand, upon reading this description, that the amount of compaction of the tape by the compactor 38 will depend on the type and/or cut of material used for the tape, and the temperature, speed, and pressure of the compactor 38. The compressed zipper 48 will be able to stretch the amount compacted.

An exemplary approach to providing stretch and recovery is shown in FIGS. 4A-4B.

In order to allow zippers to stretch and recover, the tapes may be compacted to remove their shrinkage. Then a fusible (e.g., a 2-way fusible substrate) may be applied to the back of the tapes to provide memory to the tapes.

For example, as shown in FIG. 4A, a zipper 36 may be passed through a compactor 38, e.g., as described above, to remove shrinkage of the tapes. Then a fusible substrate (or fusible) 56 may be applied to the back of the tapes (50-L, 50-R) to provide a memory and allow it to recover after it is stretched. The zipper 36 and the fusible substrate 56 are fed into a heating press 58, preferably using a guide 60. The heating press 58 may include two rollers 62, 64. The result is a zipper 66 in which the tapes have been compacted (by compactor 38) and then be fused with a fusible substrate (by heating press 58).

The speed, temperature, and pressure of the heating press 58 depend on the type of fabric used for the tapes and on the type of fusible substrate 56 being used.

The speed, temperature, and pressure of the heating press 58 need not be the same as those of the compactor 38, as the compactor 38 is used to compact the tape fabric, whereas the heating press 58 is used to fuse the fusible substrate 56 to the compacted tape fabric.

As shown in FIG. 4B, the fusible substrate 56 is preferably in two parts, namely fusible substrate 56-L for the left tape 50-L and fusible substrate 56-R for the right tape 50-R.

The fusible substrate is preferably a 2-way stretchable fusible.

As an alternative, before the zipper is assembled, the tapes may be compacted (to remove shrinkage) and then fused with a fusible to provide memory to the tapes (so that they may recover after being stretched). Then the teeth may be applied to the compacted tapes that have already been fused with a fusible substrate. In this way, the zipper will be able to stretch the amount compacted and recover an amount depending on the fusible used.

Figure 5A:
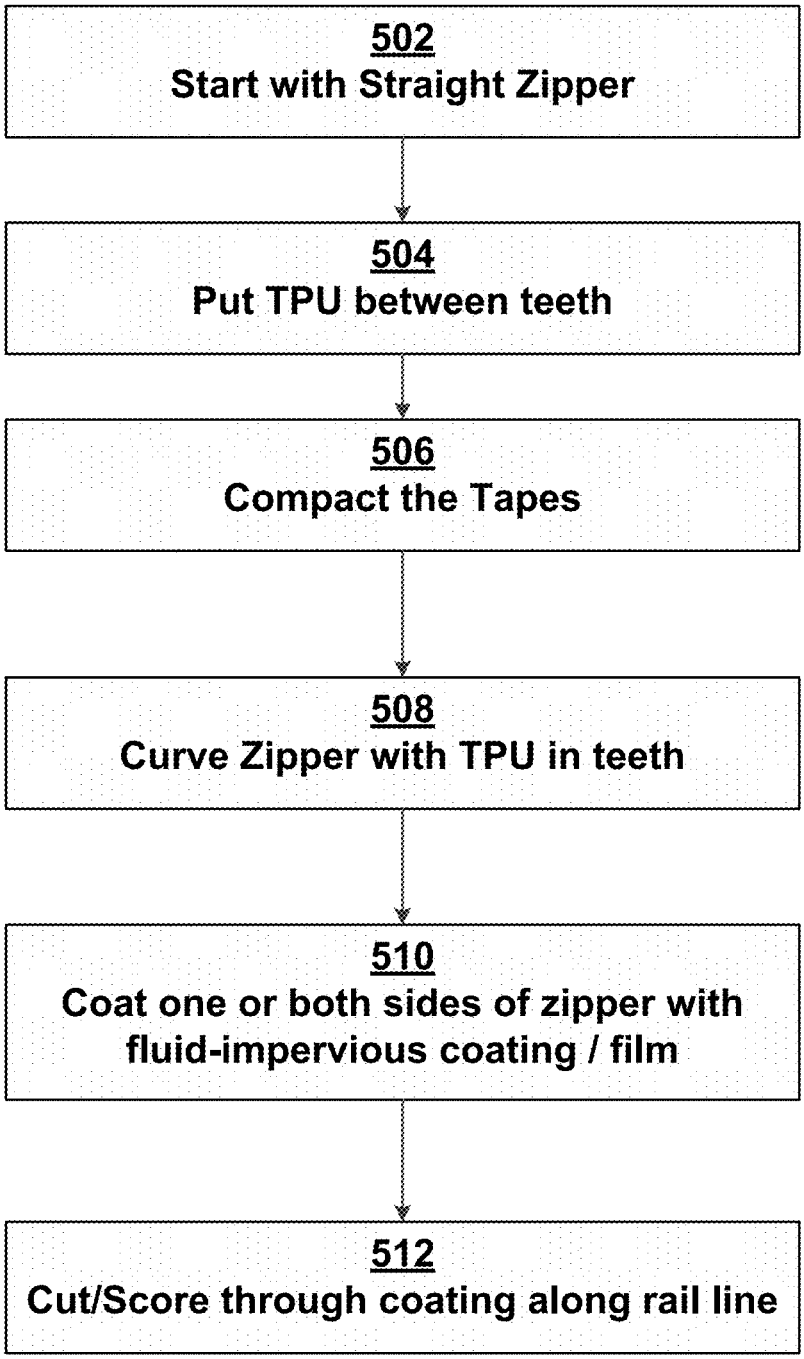
FIGS. 5A-5C are flowcharts of processes of making waterproof curved zippers according to exemplary embodiments hereof.

An exemplary process of making a waterproof curved zipper is described with reference to the flowchart in FIG. 5A and the drawings in FIGS. 6A-6F.

Start with a zipper 600 (at 502), where the zipper has a left tape 650-L and right tape 650-R connected to the rail or chain of interlocking elements 652. The rail or interlocking elements 652 is made up of left interlocking elements 652-L connected to the left tape 650-L and right interlocking elements 652-R connected to the right tape 650-R. The left interlocking elements 652-L and right interlocking elements 652-R, when interlocked, form the combined zipper chain 652. The interlocking elements 652 may be teeth or the like. To begin (at 502), the zipper 600 is preferably straight.

With the interlocking elements 652-L, 652-R interlocked (i.e., with the zipper closed), TPU or the like is put between the interlocking elements (at 504) and shown in FIGS. 6B-6E by the shading for the elements 652-L, 652-R. The TPU is preferably blown into the interlocking elements under pressure and preferably fills the gaps between the interlocking elements. The TPU may be injected with pressure onto and/or between the interlocking elements. The resulting zipper, with TPU in/on the interlocking elements, is denoted 602 in FIG. 6B.

The tapes are then compacted (at 506), and then the zipper 602 with the TPU in the teeth is then curved (at 508), e.g., a described above. As noted, the curved zipper may have more than one curved portion or section.

Figure 6A:
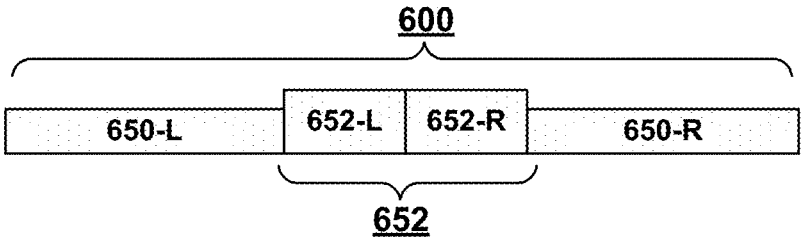
Figure 6B:
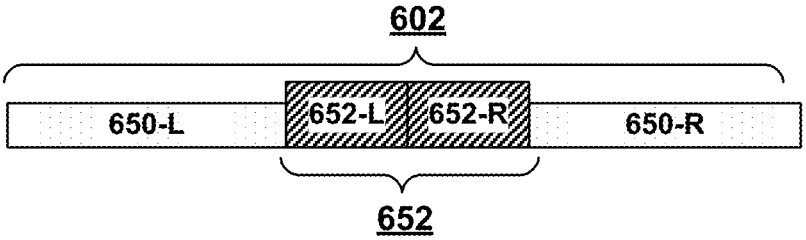
Figure 6C:
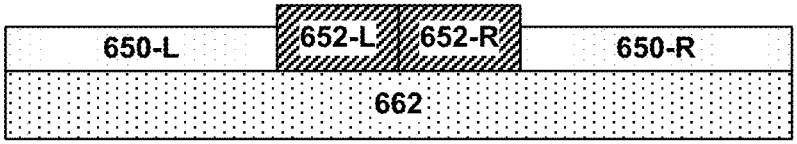

The curved zipper is may then be coated (at 510) across one or both sides with a fluid-impervious coating (e.g., formed with TPU film or the like). The coating (TPU film or the like) may be applied in the form of an adhesive strip. FIG. 6C shows the curved zipper coated with fluid-impervious coating 662, covering the bottom (the back or inside) of the zipper and FIG. 6F shows the curved zipper of FIG. 6C, also coated with fluid-impervious coating 664, covering the top (outside) of the zipper. In some cases, only the bottom (back or inside) (or only the top or front or outside) of the zipper may be coated.

Figure 6D:
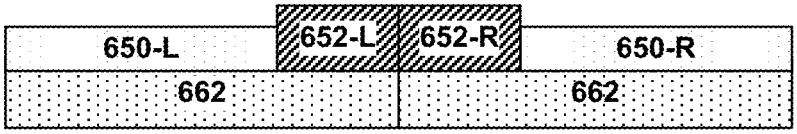
Figure 6E:
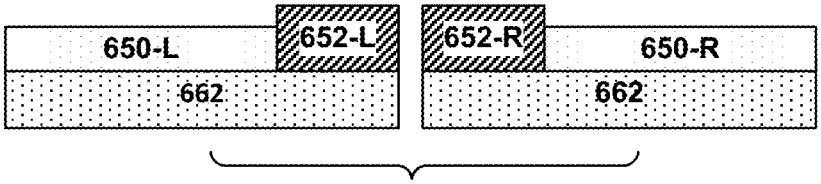
Figure 6F:
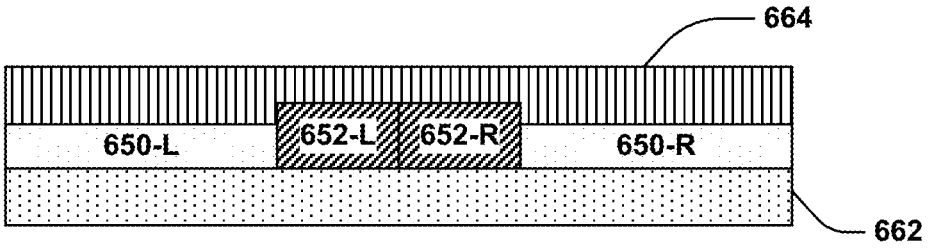
Figure 6G:
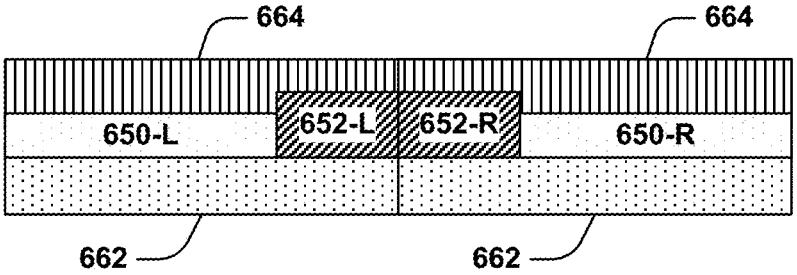
Figure 6H:
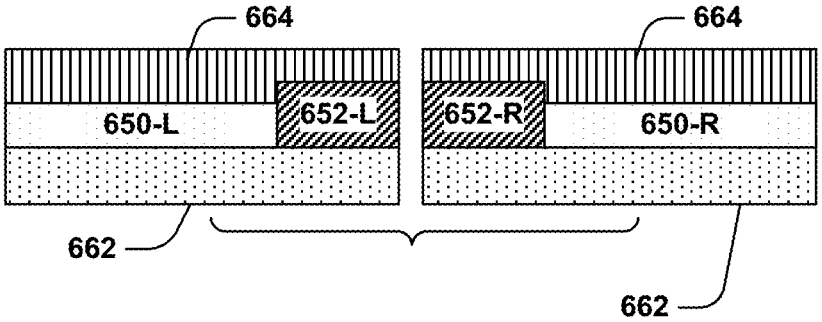

The fluid-impervious coating(s) 662 (and 664, if present) are cut or scored (at 510) along the rail 652 (preferably along the center of the rail 652), as shown in FIGS. 6D and 6G, so that the interlocking elements that make up the rail 652 may be separated (as shown, e.g., in FIGS. 6E and 6H).

In some embodiments the TPU may be put between the teeth (interlocking elements) after the zipper is curved.

Figure 5B:
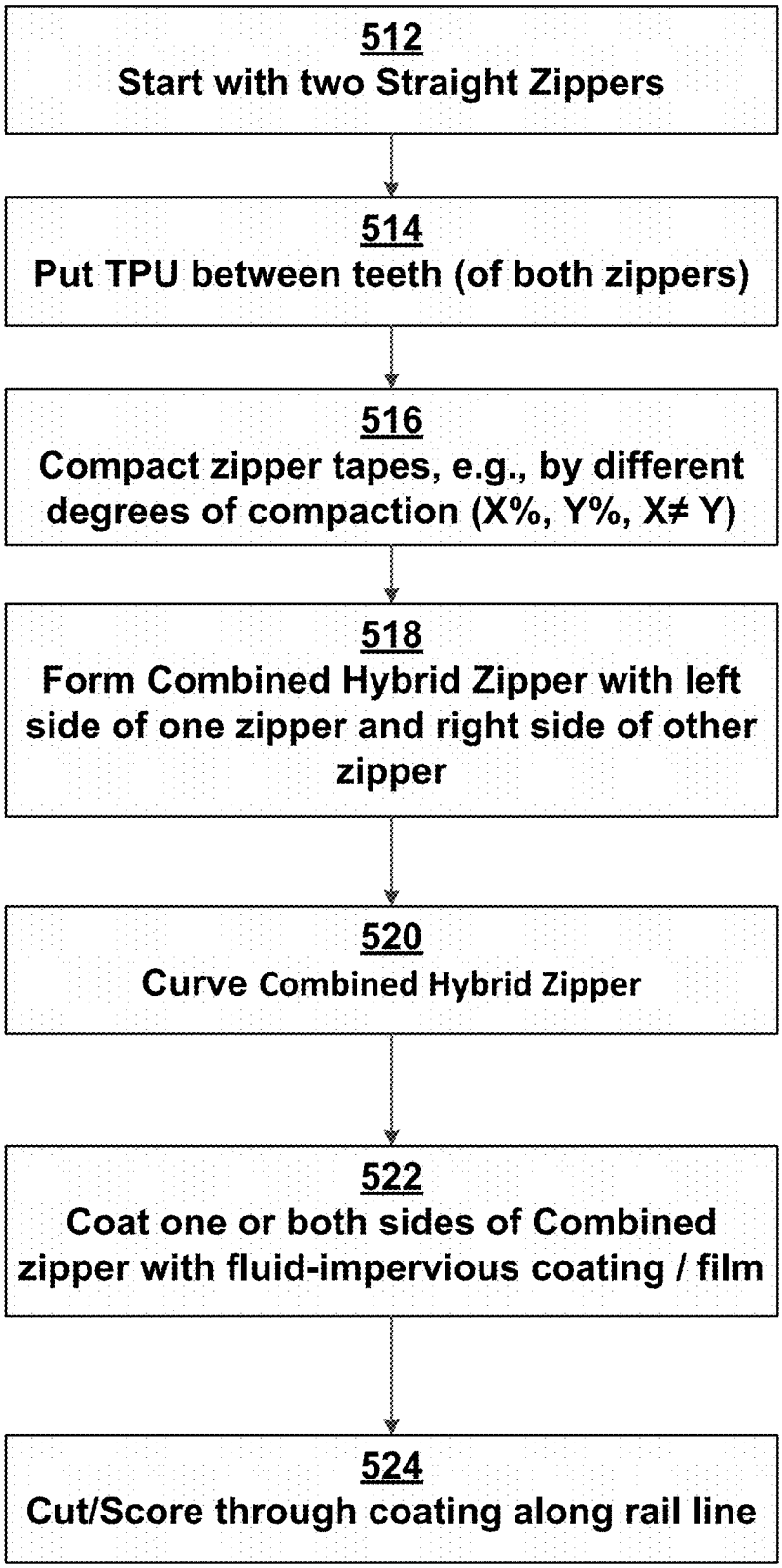

In other exemplary embodiments hereof, the tapes of distinct zippers (e.g., having distinct compaction properties) may be combined to form a combined zipper. With reference to the flowchart in FIG. 5B and the drawings in FIGS. 7A-7K, start (at 512) with two straight zippers (e.g., 700, 702 in FIGS. 7A-7B).

The first zipper 700 has a left tape 750-L and right tape 750-R connected to the rail or chain of interlocking elements 752. The rail or interlocking elements 752 is made up of left interlocking elements 752-L connected to the left tape 750-L and right interlocking elements 752-R connected to the right tape 750-R. The left interlocking elements 752-L and right interlocking elements 752-R, when interlocked, form the combined zipper chain 752.

The second zipper 702 has a left tape 750-L' and right tape 750-R' connected to the rail or chain of interlocking elements 752'. The rail or interlocking elements 752' is made up of left interlocking elements 752-L' connected to the left tape 750-L' and right interlocking elements 752-R' connected to the right tape 750-R'. The left interlocking elements 752-L' and right interlocking elements 752-R', when interlocked, form the combined zipper chain 752'.

To begin, the two zippers 700, 702 are preferably straight.

With the two zippers, each closed, TPU or the like is put between the interlocking elements of each zipper (at 514) and depicted in FIGS. 7C-7D by the shading for the elements 752-L, 752-R for the zipper 700, and elements 752-L', 652-R' of zipper 702.

The two zippers 700, 702 are then compacted, e.g., with different degrees of compaction (at 516). For example, the first zipper 700 may be compacted X percent, while the second zipper 702 may be compacted Y percent, with X≠Y. For example, X may be in the range 5-10, with Y being in the range 10-20. Exemplary compaction rates are 5% and 15%.

Next, form a combined hybrid zipper 704 (at 518) with one tape from one zipper and the other tape from the other zipper (e.g., as shown in FIG. 7E), where the left tape 750-L' (and interlocking elements 752-L') from the second zipper 702 are combined with the right tape 750-R (and the corresponding interlocking elements 752-R) from the first zipper 700. Since the zippers 700, 702 were compacted to different degrees, in the hybrid zipper 704, the left tape 750-L' of the zipper 704 has a different degree of compaction to the right tape 750-R of the zipper 704. For example, the left tape 750-L' may have compaction of Y percent, whereas the right tape 750-R may have compaction of X percent, where X≠Y.

Figure 7I:
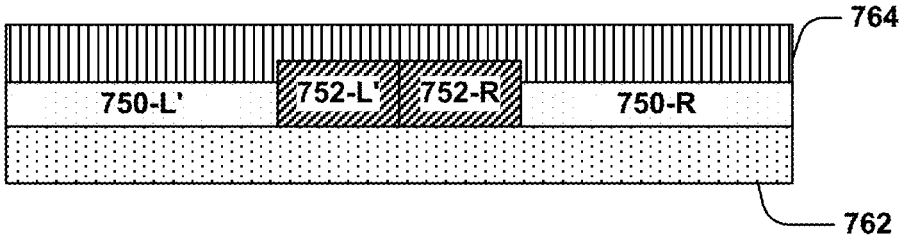
Figure 7J:
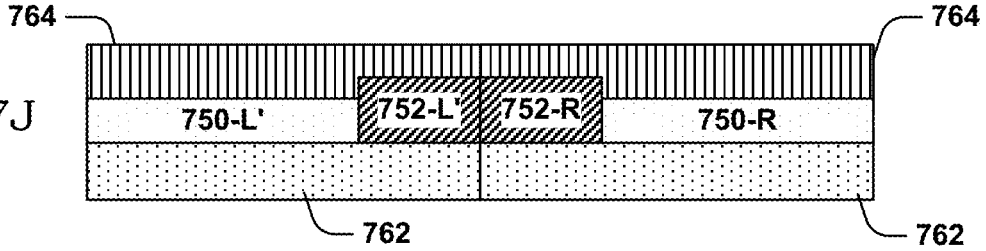
Figure 7K:
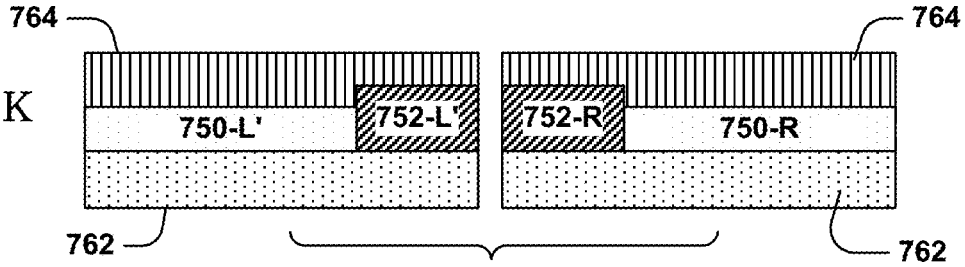

One or both sides (i.e., front/outside and/or back/inside) of the combined hybrid zipper 704 are then coated (at 522) with a fluid impervious coating/film (e.g., coating 762 on the bottom (back/inside) of the zipper, shown in FIGS. 7F-7H, or coatings 762 and 764 on both sides of the zipper, shown in FIGS. 7I-7F). The resulting coated zipper is then cut/scored along the rail line (at 524, FIGS. 7G-7H, 7J-7K), allowing the zipper to be fully opened.

In other exemplary embodiments hereof, the tapes of distinct zippers (e.g., having distinct compaction properties and/or different widths) may be combined to form a combined zipper as described with reference to the flowchart in FIG. 5C. This process is similar that described above with reference to the flowchart in FIG. 5B, but instead of the TPU being put into the separate zippers (at 514 in FIG. 5B), TPU is put between the teeth of the combined hybrid zipper (at 519 in FIG. 5C).

Figure 5C:
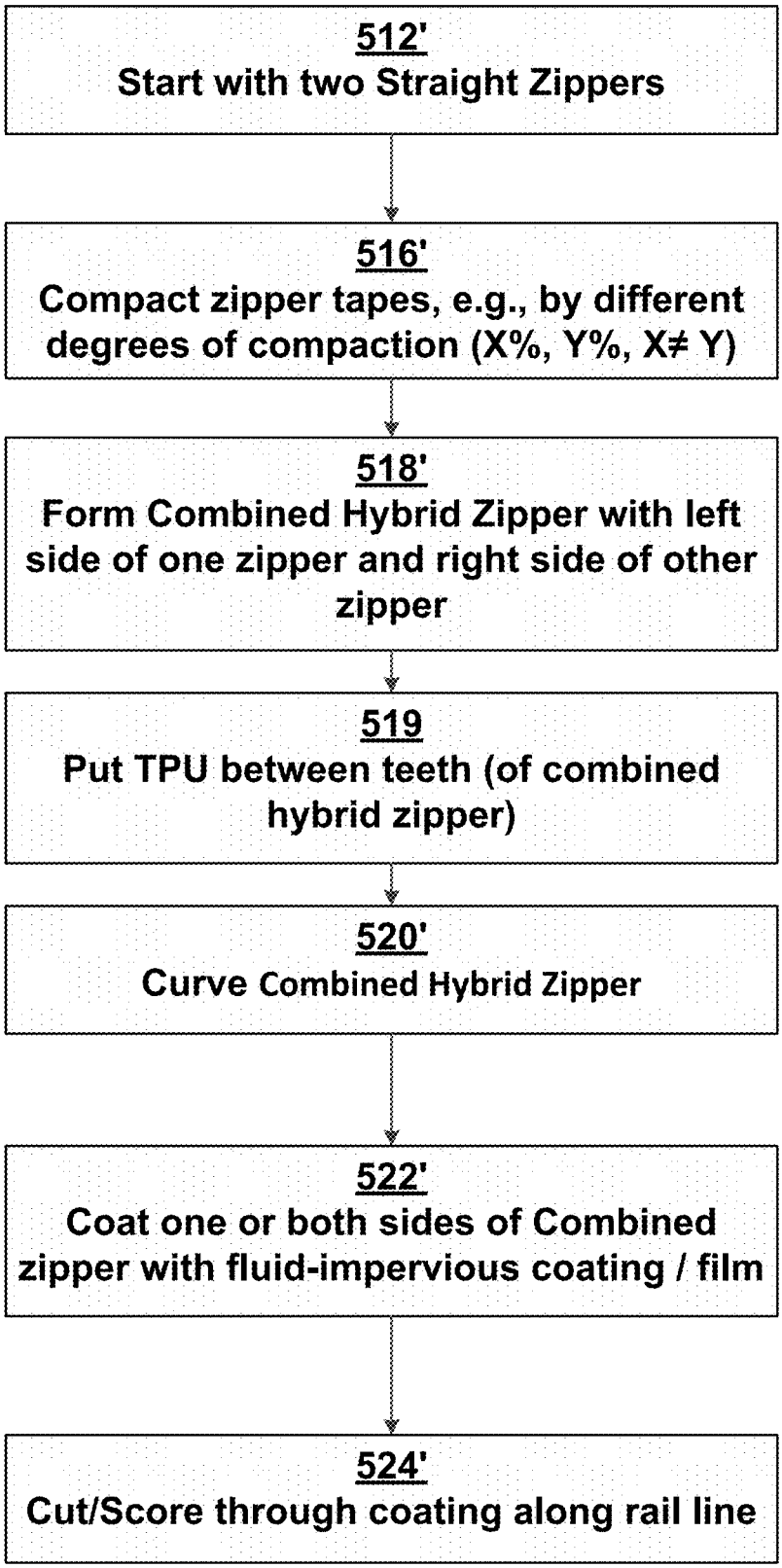

Thus, the process of FIG. 5C includes starting (at 512') with two zippers (preferably straight) (E.g., zippers 700, 702, FIGS. 7A-7B). The two zippers are then compacted, e.g., with different degrees of compaction (at 516'). For example, the first zipper may be compacted X percent, while the second zipper may be compacted Y percent, with X≠Y. For example, X may be in the range 5-10, with Y being in the range 10-20. Exemplary compaction rates are 5% and 15%.

Figure 8A:
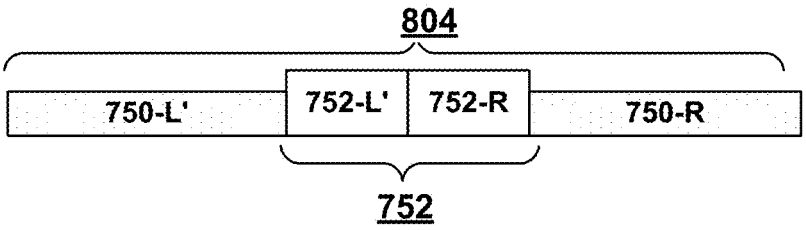

Next, a combined hybrid zipper is formed (at 518') with one tape from one zipper and the other tape from the other zipper (zipper 804, FIG. 8A).

Figure 8B:
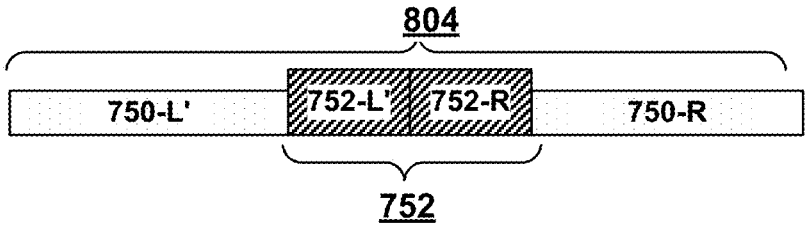

TPU is put between the teeth of the combined hybrid zipper (at 519) (FIG. 8B).

The combined hybrid zipper is curved (at 520).

One or both sides (i.e., front/outside and/or back/inside) of the combined hybrid zipper are then coated (at 522') with a fluid impervious coating/film (e.g., on the bottom (back/inside) of the zipper, or coatings and on both sides of the zipper) (FIGS. 7F-7I). The resulting coated zipper is then cut/scored along the rail line (at 524') (FIGS. 7J-7K), allowing the zipper to be fully opened.

Connecting Zippers to Items (Products)

The zippers described herein are preferably waterproof. When connected to an item (e.g., garment, luggage, etc.), it is desirable for the connection also to be waterproof.

In some cases, a zipper may be stitched to an item by stitching along the tapes. The stitching creates holes in the tapes that may cause some leakage. The leakage may be minimal and may be tolerable for a particular application (e.g., a suitcase). Alternatively, the stitching may use a thread that swells when wet, thereby blocking the holes when the item gets wet.

Instead or in addition, a sealing tape may be applied to the item after the zipper is attached, covering the holes caused by the stitching.

In some cases, the tapes may be attached by welding or glue or the like, with or without stitching.

In addition to leakage caused by stitching, as described above, there may be some leakage at the slider. Again, such leakage may be minimal and tolerable.

Additional structure may be added to at least some of the items to further cover the zipper to maintain the waterproofing of the items.

EXAMPLES 1.1 A waterproof zipper is provided having one or more curves.

1.2 One or more waterproof zippers, each having one or more curves, are used with a product.

1.3 One or more waterproof zippers, each having one or more curves, are used with a product selected from: a garment, footwear, an item of luggage, an item of sports equipment, boat covers, bags, pencil cases, backpacks, computer/laptop cases, luggage, zip-up portfolio case, zip-up storage bins for toys, sleeping bags, tents, children make up/toiletry bags, lunch bags, hats with zipper pockets, toys, toy clothing, a handbag, and others.

Thus are described various waterproof zippers, items using the waterproof zippers, and methods of making the waterproof zippers and the items.

CONCLUSION

As used herein, including in the claims, the phrase "at least some" means "one or more" and includes the case of only one. Thus, e.g., the phrase "at least some ABCs" means "one or more ABCs" and includes the case of only one ABC.

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least" and is not exclusive. Thus, e.g., the phrase "using X" means "using at least X." Unless specifically stated by use of the word "only", the phrase "using X" does not mean "using only X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and "third," in the description and claims are used to distinguish or identify and not to show a serial or numerical limitation. Similarly, the use of letter or numerical labels (such as "(a)," "(b)," "(c)," and so on, or "(A)," "(B)," "(C)," and so on, or "(i)," "(ii)," and so on, and the like) are used to help distinguish and/or identify, and are not intended to be otherwise limiting or to impose or imply any serial or numerical limitations or orderings.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method comprising:

(A) providing a zipper with a left tape and a right tape each connected to a rail of interlocking elements;

(B) with the interlocking elements of the left tape interlocked with the interlocking elements of the right tape, putting TPU (thermoplastic polyurethane) between the interlocking elements;

(C) compacting the left tape and the right tape and forming at least one curve in the zipper; and then (D) coating one or both sides of the zipper with fluid-impervious coating; and then (E) scoring the fluid-impervious coating along the rail.

2. The method of claim 1, wherein TPU is put between the interlocking elements in (B) after the compacting in (C).

3. The method of claim 1, wherein at least a curved portion of the left tape and a corresponding curved portion of the right tape are asymmetric about the interlocking elements.

4. The method of claim 1, wherein, after compacting in (C), the zipper has more than one curve.

5. The method of claim 1, wherein, in (A), the zipper is straight.

6. The method of claim 1, wherein, in (B), the TPU is blown and/or injected into the interlocking elements under pressure.

7. The method of claim 1, wherein, in (D), the coating is applied in the form of an adhesive strip.

8. A method comprising:

(A) providing (a) a first zipper with a first left tape and a first right tape connected to a first rail of first interlocking elements, and (b) a second zipper with a second left tape and a second right tape connected to a second rail of second interlocking elements;

(B) compacting the first left tape and the first right tape, and compacting the second left tape and the second right tape; and then (C) forming a third zipper from the left first tape and the right second tape;

(D) with the interlocking elements of the third zipper interlocked, putting TPU (thermoplastic polyurethane) between the interlocking elements of the third zipper;

(E) curving the third zipper to form at least one curve in the third zipper; and then (F) coating one or both sides of the third zipper with fluid-impervious coating; and then (G) scoring the fluid-impervious coating along the rail of the third zipper.

9. The method of claim 8 wherein the third zipper is curved in (E) before putting TPU between the interlocking elements of the third zipper in (D).

10. The method of claim 8, wherein, for the third zipper, at least a curved portion of the left first tape and a corresponding curved portion of the right second tape are asymmetric about the interlocking elements.

11. The method of claim 8, wherein the third zipper has more than one curve.

12. The method of claim 8, wherein, in (A), the first zipper is straight, and the second zipper is straight.

13. The method of claim 8, wherein, in (D), the TPU is blown and/or injected under pressure into the first interlocking elements and into the second interlocking elements.

14. The method of claim 8, wherein, in (F), the coating is applied in the form of an adhesive strip.

15. A method comprising:

(A) providing (a) a first zipper with a first left tape and a first right tape connected to a first rail of first interlocking elements, and (b) a second zipper with a second left tape and a second right tape connected to a second rail of second interlocking elements;

(B) with the first interlocking elements of the first zipper interlocked, putting TPU (thermoplastic polyurethane) between the first interlocking elements; and with the second interlocking elements of the second zipper interlocked, putting TPU between the second interlocking elements;

(C) compacting the first left tape and the first right tape, and compacting the second left tape and the second right tape;

(D) forming a third zipper from the left first tape and the right second tape;

(E) curving the third zipper formed in (D) to form at least one curve in the third zipper; and then (F) coating one or both sides of the third zipper with fluid-impervious coating; and then (G) scoring the fluid-impervious coating along the rail of the third zipper.

* * * * *